United States Patent [19]

Brantl et al.

[11] 4,120,309

[45] Oct. 17, 1978

[54] HAND OPERATED DEVICE FOR PRODUCING TOBACCO ARTICLES LOW IN NOXIOUS SUBSTANCES

[76] Inventors: Victor Brantl, Frauenplatz 10, 8 Munich 2; Wolfgang Seeger, Portenlaengerstr. 17, 8022 Gruenwald, both of Fed. Rep. of Germany

[21] Appl. No.: 740,871

[22] Filed: Nov. 11, 1976

[30] Foreign Application Priority Data

Sep. 3, 1976 [DE] Fed. Rep. of Germany ..... 2639820

[51] Int. Cl.[2] ..... A24F 13/00; A24F 25/00; A24F 47/00

[52] U.S. Cl. ..... 131/170 R

[58] Field of Search ..... 131/188, 170 R, 233, 131/262, 253, 13, 255

[56] References Cited

U.S. PATENT DOCUMENTS

| | | | |
|---|---|---|---|
| 127,649 | 6/1872 | Sheehy | 131/252 X |
| 137,850 | 4/1873 | Levy et al. | 131/252 |
| 2,333,049 | 10/1943 | Shapiro | 131/170 R X |
| 3,349,779 | 10/1967 | Bell et al. | 131/13 X |

FOREIGN PATENT DOCUMENTS

| | | | |
|---|---|---|---|
| 1,392,716 | 2/1965 | France | 131/254 |
| 1,480,249 | 4/1967 | France | 131/254 |

*Primary Examiner*—Stephen C. Pellegrino
*Attorney, Agent, or Firm*—Bacon & Thomas

[57] ABSTRACT

A manually actuated device for modifying conventional tobacco articles to provide articles with a low content of noxious substances, comprising a holder for holding the tobacco articles and a device for creating a tobacco-free space at a position adjacent to the longitudinal axis of the tobacco article.

15 Claims, 27 Drawing Figures

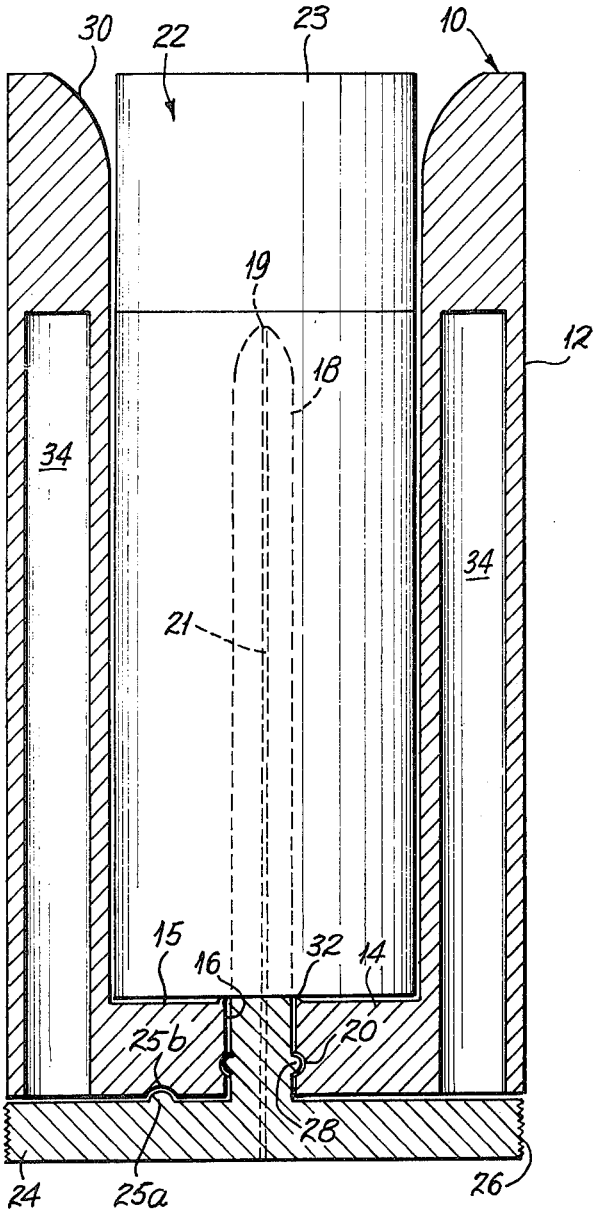
Fig. 1
Fig. 2
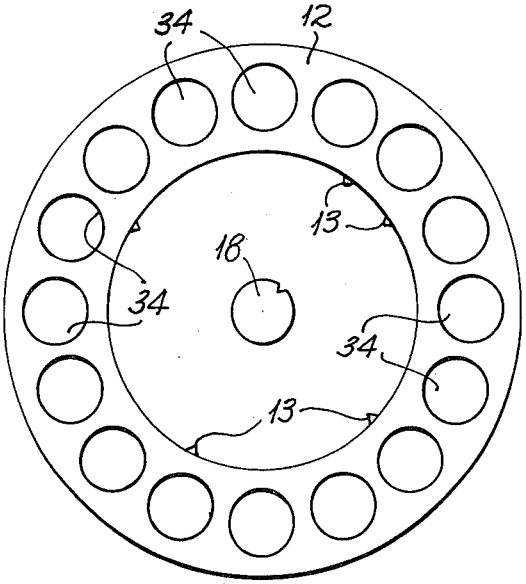
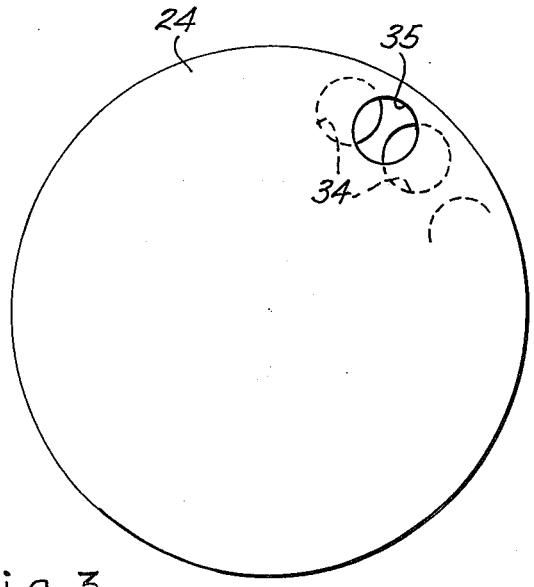
Fig. 3

HAND OPERATED DEVICE FOR PRODUCING TOBACCO ARTICLES LOW IN NOXIOUS SUBSTANCES

The invention relates to a hand operated device for converting conventional tobacco articles into articles low in noxious substances.

It has been known for a long time that carbon monoxide is a highly poisonous gas, which more particularly damages the cardiac blood vessels and that the gas of combustion from tobacco bears a very high proportion of carbon monoxide. Despite familiarity with this fact and despite the multiplicity of research and other attempts, on which a large amount of money has been spent, at reducing the amount of noxious substances in the gases of combustion from tobacco, it has not as yet been possible to do anything more than produce a substantial reduction in the nicotine and tar contents, while the carbon monoxide content has not been reduced in any manner worthy of notice. On the contrary it is just some filter cigarettes with a low nicotine content which have a particularly high carbon monoxide content in the gas of combustion. It has been found that carbon monoxide cannot be removed by filters to any practical extent.

One aim of the invention is that of providing a device which makes it possible for a smoker to modify the machine-made tabacco articles which he buys, or also hand-made tobacco articles, in such a manner that on smoking they only produce a small amount of noxious substances, more particularly carbon monoxide, in the combustion gas.

This aim is to be achieved in accordance with the invention by means of a holder for holding the tobacco article and by a device for creating a tabacco-free space adjacent to the longitudinal axis of the tobacco article.

In this tobacco-free space a body is inserted which is substantially impermeable for air.

Such a modified article therefore does not comprise any tabacco in a zone adjacent to its longidutinal axis. Therefore in the case of the tobacco article so modified, which can for example be a cigarette, just that zone does not play a part in combustion, in which otherwise most carbon monoxide is produced during combustion, this being because, on the one hand, this zone receives the least amount of air and on the other hand because in it the combustion temperature is the highest and there is the greatest displacement of the Boudouard equilibrium towards more carbon monoxide. It has been found that in the case of such modified cigarettes — which in what follows are to be covered non-exclusively by the general term tobacco article — the carbon monoxide content in the smoke is reduced by more than 50%, if the diamter of the incorporated insert has a diameter of approximately 3 mm and the cigarette has a diameter of 8 mm. It has furthermore been found that the filter shows less brown discoloration after smoking than is the case with the filter of a non-modified cigarette which is the same and comes from the same cigarette package and has not been modified. It can be seen from this that the cigarette modified with the device in accordance with the invention also comprise a lower proportion of discoloring condensate and therefore, presumably, also of nicotine.

The degree of reduction in the content of noxious substances depends on the one hand on the diameter of the incorporated insert, this reducing effect increasing with an increase in the diameter of the insert. Furthermore the reduction effect also depends on how impermeable to air the insert is. The greatest effect to a non-heat conducting insert is produced if it is completely impermeable to air, that is to say when no air can pass through the void zone adjacent to the longitudinal axis laterally into the annular tobacco space. The effect decreases by an increase in the air permeability of the insert.

Furthermore the reducing effect also depends upon the thermoconductivity of the insert and the temperature, which is affected by this, in the incandescent zone. A solid insert of metal with a relatively small diameter brings about the same reduction in the content of noxious substances as a solid insert of non-conducting material as for example paper, with a larger diameter. Finally it is also to be pointed out that an insert of metal, in contrast to a non-thermally conducting insert, with a very low permeability to air reduces the content of noxious substances and more particularly the CO content to an even greater extent than an insert which is completely impermeable to air.

The invention thus involves the substantial advantage that it has for the first time provided a smoker with the possibility of reducing the effective content of noxious substances in commercially available cigarettes. He can accordingly produce cigarettes or tobacco articles in general, whose CO content is lower than in the case of any cigarette which can be obtained commercially.

Such an effective reduction in noxious substances in tobacco articles is not only interesting for light smokers. Strong flavor cigarettes, which are modified with the device in accordance with the invention and are provided with a substantially air impermeable insert, have approximately the same effect as regards the reduction of carbon monoxide. Since carbon monoxide is invisible, odorless and tasteless and furthermore is highly toxic, a reduction in its content is also of advantage for those who prefer strong cigarettes. Furthermore the reduction effect described occurs both in the case of filter cigarettes and also in the case of cigarettes without filters.

In accordance with a further development of the invention the device for creation of the tobacco-free space is mandrel, which on being introduced into the tobacco article displaces the tobacco. This mandrel can preferably be generally conical or frusto-conical at its front end.

Owing to this further development of the invention the introduction of a mandrel brings about displacement of tobacco substantially in a radial direction into the annular tobacco space and only causes a very slight compaction of the tobacco in the longitudinal direction of the tobacco article.

A solid insert, which has sufficient rigidity can be introduced manually into the tobacco-free space of a cigarette after the latter has been created by the introduction of a mandrel and removal of the latter. It is however convenient, after removal of the mandrel, for the cigarette to be left for the moment in the holder while the insert is being inserted into the tobacco-free space.

The above described reducing effect however does not depend upon whether the insert is solid or hollow. What is significant is that the annular tobacco space is separated from the tobacco-free space in a substantially air impermeable manner. It is therefore also possible to incorporate a hollow internal rod or stick, for example of paper, as a partition, which is impermeable to air both laterally and also at the rear, between the tobacco and the space free of tobacco. Such a hollow inner rod is generally not sufficiently rigid for it to be produced into the tobacco-free space, since after withdrawal of the mandrel a few particles or crumbs of tobacco will be pushed back into the tobacco-free space owing to their resiliency.

Furthermore such hollow inner rods with very thin walls can be introduced into the tabacco articles to be modified using the device in accordance with the invention. For this purpose after withdrawal of the mandrel from the tobacco article it is only necessary to place such a hollow inner rod on the mandrel and to introduce the latter into the tobacco article again. On withdrawing the mandrel such a hollow inner rod, which owing to its low wall thickness could better be termed a partition, jams against the tobacco and is held less by the mandrel so that the matter can be withdrawn from the hollow inner rod again without any difficulty.

It has furthermore been found that those cigarettes also afford a considerably reduced carbon monoxide content, whose annular tobacco space is separated from the tobacco-free space by a double-walled tube which is open to the front and the rear and which owing to the action of the incandescent zone becomes substantially impermeable to air. Such a double-walled tube can for example consist of an outer partition tube of paper and a plastics tube lying snugly against it, which becomes sealed in an air-tight manner in the longitudinal direction owing to the action of the incandescent zone.

Such tubes which are open to the front and the rear can furthermore only be introduced with difficulty with a mandrel whose front end is pointed into a tobacco article. Even if the rear end of the mandrel is provided with an abutment, which prevents further sliding of the tube to the rear, there would be the danger of the front edge of this double-walled tube being damaged on introduction and to the tobacco article so that the tube would become permeable to air.

In order to make possible the introduction of such double-walled tubes into tobacco articles, the mandrel in accordance with the invention is further developed in the following manner. At its front end the mandrel has a body, which is constructed so that it can be expanded and contracted and in its expanded condition generally has the shape of a cone or a frustum of a cone, whose rear section projects in all directions beyond the outer periphery of the shank of the mandrel and which in its contracted condition is arranged completely within the produced, that is to say extended surface of the shank of the mandrel.

On introducing the mandrel into the tobacco article and on displacement of the tobacco into the annular tobacco zone this body is expanded and in this respect the rear section, which projects on all sides beyond the shank, does not cause any difficulty. This section projecting on all sides would impede the withdrawal of the mandrel if the latter were not so constructed that on withdrawal of the mandrel the body firstly collapses so that the mandrel can be withdrawn without any impediment. In the case of this arrangement with the collapsed body on the front end the double-walled tube is pushed on to the mandrel. When the mandrel is now to be pushed into the tobacco article again firstly the front body is expanded so that its rear section projects on all sides also beyond the front edge of the double-walled tube and protects the latter edge. After the mandrel has been introduced together with the double-walled tube, firstly its front body is caused to collapse and then the whole mandrel can be drawn without impediment from the double-walled tube, which remains in the tobacco article.

In accordance with a further development of the invention in the central part of this mandrel a punch is arranged for introducing tubes and the front end of the punch is connected with the body, on whose front part bands are attached, which at their other end are attached to the flexible casing of the body and on which transverse pins are fixed, which extend through slots arranged in the rigid shank and these slots are so dimensioned in their length that they form abutments for the pins both in the upper and also in the lower end position of the punch in relation to the rigid shank.

In the case of this further development of the invention the total compression force and also the tension force is used for introducing the mandrel into the tobacco article and also for drawing out the latter on to the punch. The latter expands, or respectively, contracts the body firstly on the front end or the shank and then entrains the rigid shank by means of the entraining pins and the slot in the wall of the rigid shank. It is therefore sufficient to exert the forward and backward guiding force only on a rigid part, that is to say the punch. The control of the relative position of this punch with respect to the rigid shank of the mandrel then occurs automatically.

On the shank of the mandrel it is possible to provide an abutment for the insert to be placed on the mandrel, that is to say both for the inner rod and also for the double-walled tube.

For introducing the tube the shank of the mandrel can also be constructed over its whole length so as to taper. If the tubes are constructed in a complementary manner they will make snug engagement with the shank and cannot slip to the rear beyond their predetermined end position on the mandrel.

Preferably the clearance width of the holder holding the tobacco article is generally the same or slightly smaller than the external diameter of the tobacco article.

If the clearance width of the holder were substantially larger it would not provide any lateral support for the tobacco article while the tobacco-free space is being produced. If on the other hand the clearance width is smaller than the external diameter of the tobacco article, difficulties arise on inserting the tobacco article. This introduction of the cigarette can be facilitated to a greater extent if the external wall of the holder is very smooth. On the other hand if it is very smooth it cannot prevent rotation of the tobacco article if for example the mandrel is rotated on introduction into the article about its longitudinal axis.

In order to satisfy these antagonistic requirements as regards the holder the latter is provided, in accordance with a further development of the invention, which means for changing its internal diameter. After the introduction of the cigarette the internal diameter of the holder is decreased so that while it is possible for the cigarette to be introduced easily, it can then be held in a slip-free manner.

In accordance with another embodiment of the invention the holder can have inwardly projecting ridges extending in the longitudinal direction.

This further development of the invention involves the advantage that the internal diameter of the holder can be slightly larger than the external diameter of the tobacco article while the internal diameter formed by the projecting ridges can be slightly smaller than that of the tobacco article. In the case of this further development of the invention the tobacco article is only compressed slightly along these ridges on insertion into the holder so that the frictional force opposing introduction is very low. Simultaneously these ridges ensure that the introduced tobacco article cannot turn in relation to the holder about its longitudinal axis. There is however the further advantage in this respect that on introduction of a mandrel the inner wall of the holder forms a support for the casing of the tobacco article, for example for the cigarette paper, between the ridges so that the casing cannot be damaged by the radial pressure on introduction of the mandrel.

In order to increase the holding action on the tobacco article to prevent rotation about its longitudinal axis it is also possible for the diameter of the rearmost part of the holder to be constructed so that it tapers in the manner of a wedge.

In accordance with a further development of the invention a stripper is provided, which lies against the mandrel and on returning the latter from the tobacco article ensures the detachment of the insert mounted on the mandrel.

The holder can, in accordance with a further development of the invention, have a rear wall on its one end and this wall forms a counter-abutment for the tobacco article and has a through hole, which serves for receiving and guiding the mandrel. Conveniently the wall of the hole can have an annular groove made in it in its lower edge part and this groove cooperates with a ridge or pin, projecting at the rear end zone of the mandrel, a detent connection. This detent connection ensures that the mandrel cannot fall out of the holder. The holder accordingly simultaneously forms a container for the mandrel.

The mandrel can be firmly connected with a pressure plate at its rear end. This further development of the invention makes it easier to hold the mandrel. As a result both the insertion of the mandrel and also withdrawal in the longitudinal direction of the holder is simplified. This increased ease of holding the mandrel also facilitates rotation of the latter by this longitudinal axis while it is being moved into and withdrawn from the tobacco article.

In accordance with another further development of the invention an operating member is provided, on which the device creating the tobacco-free space is attached and which can be slid on to the holder. In the case of this further development of the invention the holder simultaneously forms a guide for the operating member and accordingly a guide for the mandrel fixed on the latter. In this manner it is possible to ensure that the mandrel moves precisely in the central part of the tobacco article along its longitudinal axis, this being important since the reducing effect is optimum when the insert is arranged precisely centrally in the tobacco article, while the reducing effect is substantially smaller if the insert is arranged in the outer edge part of the tobacco article.

The holder can have a thread in its outer side which is constructed so as to be complementary with respect to a mating thread on the inner side of the operating member. For putting together the operating member and the holder accordingly are turned in relation to each other so that introduction to the mandrel into the tobacco article is facilitated.

The device created the tobacco-free space does not necessarily have to be a rigid mandrel, which only displaces the tobacco out of the central part of the tobacco article. In accordance with a further development of the invention the device creating the tobacco-free space can consist of two tubes placed one inside the other which can be turned in relation to each other and which at their front end have cooperating cutting teeth rings and of which the one tube is connected with the operating member in such a manner as to prevent relative rotation while the other tube can be rotated with respect to the operating member. When in accordance with this further development of the invention the holder is screwed on the operating member and simultanieously the inner tube is held fast, the cutting teeth rings rotating in relation to each other. As a result the tobacco located between them is chopped up so that a part of the tobacco arranged in the central part of the tobacco article passes into the inner tube.

In accordance with a further development of the invention the inner tube extends through an opening in the rear wall of the operating member and is connected with a rotary plate in a manner preventing relative rotation and the rotary plate is arranged behind the rear wall of the holder so as to be able to rotate in relationship to the operating member.

After placing the tobacco article in the holder and placing the operating member on the front edge of the holder it is possible with this further development of the invention to exert pressure on the lower side of the holder and from the opposite side so as to push the rotary plate, holder and operating member into each other. In this case one hand is used to hold the holder and the other hand holds the rotary plate so that the holder and the inner tube rigidly connected with the rotary plate do not rotate. The outer tube rigidly connected with the holder on the other hand is turned, since the operating member is caused to form a rotary movement owing to the thread.

Naturally it is also possible to turn the rotary plate in the opposite direction to the operating member on pushing the holder and the operating member together so that the relative speed between the cutting tooth ring of the outer tube and the cutting tooth ring of the inner tube is still further increased.

In accordance with another further development of the invention a peripheral annular groove is arranged in the wall of the opening of the operating member and this groove cooperates with a ridge projecting from the inner tube in forming a detent connection between the holder on the one hand and the unit on the other hand which consists of the rotary plate and the inner tube. With this further development of the invention it is possible to remove the inner tube from the outer tube simply by pulling on the rotary plate for cleaning. Furthermore this detent connection is so constructed on the inner side adjacent to the operating member that pressure on the rotary plate is transmitted to the operating member.

The outer and the inner tubes can be inwardly rounded at their front ends and can have tooth rings directed obliquely inwards and forwards.

This further development of the invention offers the advantage that the rounding of the outer tube must displace a part of the tobacco from the zone adjacent to the longitudinal axis laterally into the annular space and only a small part of the tobacco in the zone adjacent to the longitudinal axis has to be chopped up. In this manner it is possible to remove a smaller quantity of tobacco from the tobacco article.

The manual device can, in accordance with a further development of the invention, be arranged in a cigarette case or it can be constructed as part of such a case.

The insert to be incorporated in the tobacco article preferably extends over the whole length of the article which is burnt on smoking. For tobacco articles of different lengths, for example cigarettes of different lengths, it is therefore also possible to use inserts with correspondingly different lengths. In the case of the embodiment of the manual device of the invention described with one holder and one operating member it is possible to modify cigarettes of any desired length if the internal space of the holder is so long that it can accommodate the longest commercially available cigarettes. In every case it is possible to use the same mandrel to introduce the insert as far as the same distance from the end face of the tobacco article, or the end face of the tobacco adjacent to the filter. This is possible because the end position of the point of the mandrel is determined by the end position of the operating member in relation to the holder. On the other hand a smoker may desire to introduce the insert in the case of filter cigarettes with different lengths of filters as far as the same distance from the end face from the tobacco side.

This is possible in the case of a further development of the invention in the case of which the operating member has a cylindrical opening on its rear wall, which has diametrally opposite grooves, along which pins which project from the mandrel at diametrally opposite positions can be introduced from a front end position into a rear end position.

This embodiment makes possible the adaptation of the depth of penetration of the mandrel to two different filter lengths. Naturally the grooves can also be so constructed that several stop positions for the rear end of the mandrel in relation to the operating member are provided for.

In accordance with a further development of the invention magazines are provided in the holder and/or operating member for accommodating inserts which which have to be placed into the tobacco article. These magazines can consist of chambers formed in the side walls of the holder or, respectively the operating member.

The chambers in the holder and/or the chambers in the operating member can be terminated by a lid which can be rotated in relation to them and which has an opening which can be brought into alignment with all chambers in turn and can be stopped by a detent connection in relation to the holder or respectively the operating member in order to prevent rotary movement.

This further development of the invention is more particularly useful when thin-walled inserts are to be introduced into the tobacco articles and which easily kink, break or tear and are therefore to be protected against pressure and deformation.

The scope of the invention also comprises such forms of manual devices in the case of which the holder and operating member are attached so that they can be moved in relation to each other The operating member carrying the mandrel can be displaced in relation to the holder in the longitudinal direction and in its extended condition can be naturally pivoted in relation to the holder in the way in which it is fixed to the latter.

For this purpose the holder can have two guiding and holding grooves running in the longitudinal direction, into which a pin, projecting inwards from the operating member, fits and is guided.

The invention will be described in what follows with reference to several embodiments in conjunction with the drawing in more detail:

FIG. 1 is a cross-section through a first embodiment and a plan view of a cigarette lying in it.

FIG. 2 is a cross-section through a holder in accordance with FIG. 1 and through a mandrel located in it.

FIG. 3 is a view looking on to the rear side of the embodiment of FIG. 1.

Figure 4A:
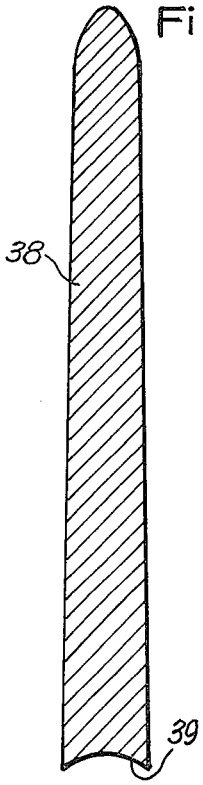

FIG. 4*a* is a cross-section through an insert to be introduced into cigarettes.

Figure 4B:
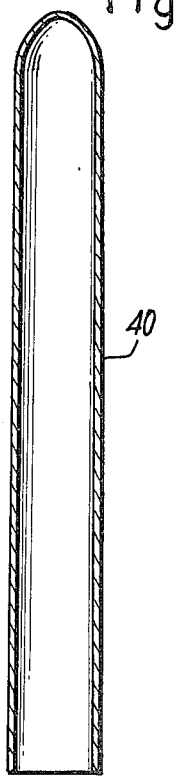

FIG. 4*b* is a cross-section through another embodiment of an insert to be introduced into cigarettes.

Figure 4C:
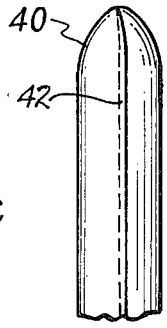

FIG. 4*c* is an elevation of the insert in accordance with FIG. 4*b*.

Figure 5:
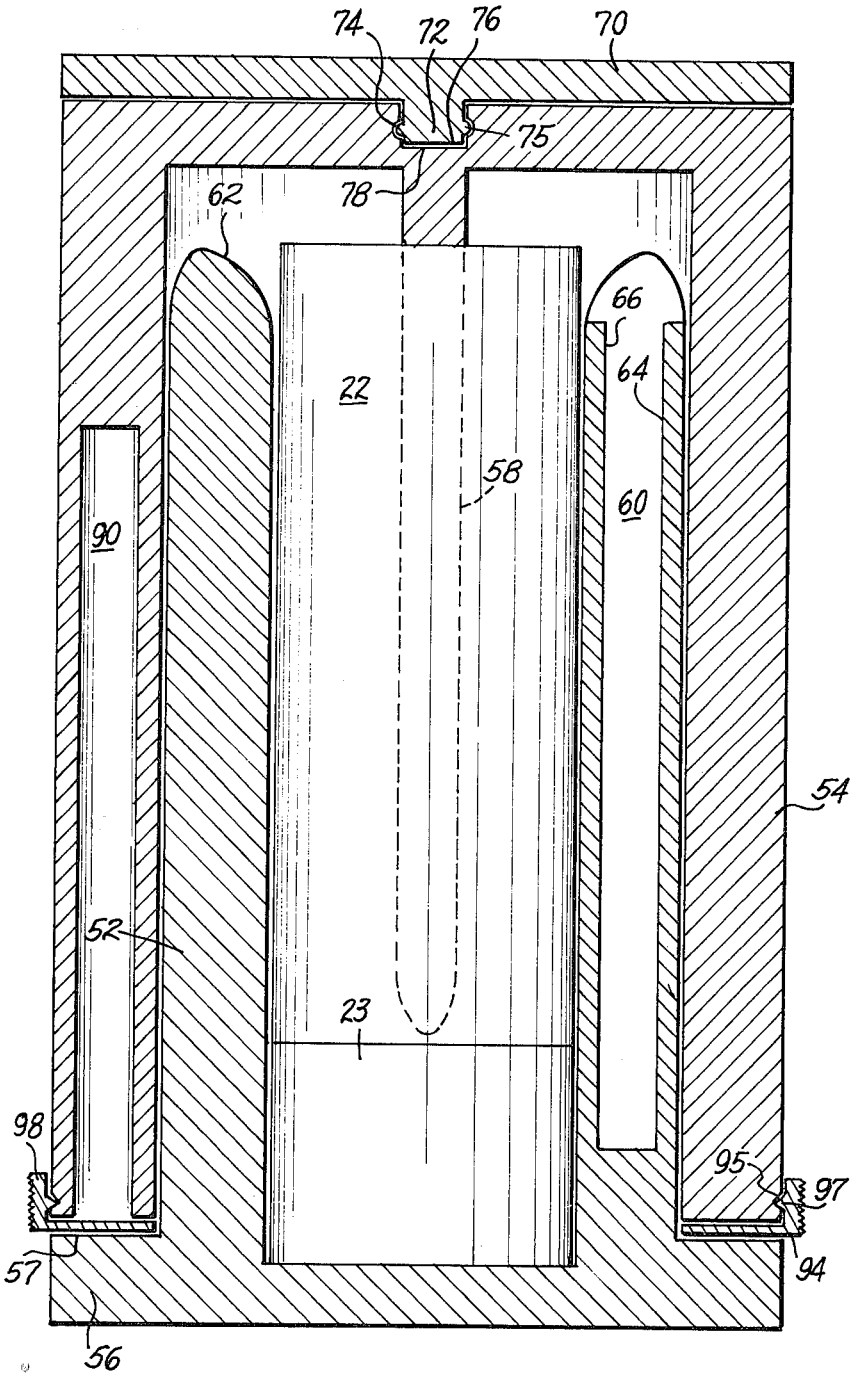

FIG. 5 is a longitudinal section through another embodiment of the invention with a holder constructed as a casing and also an operating member constructed as a casing.

Figure 6:
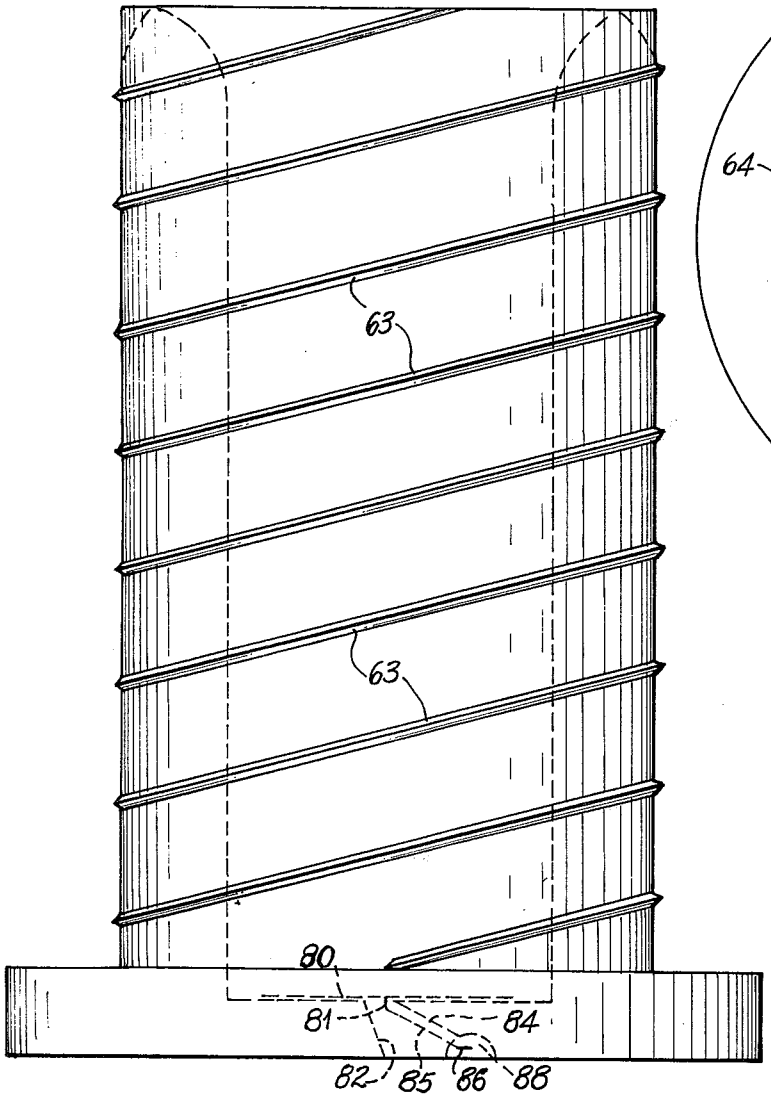

FIG. 6 is an elevation of the holder of the embodiment in accordance with FIG. 5.

Figure 7:
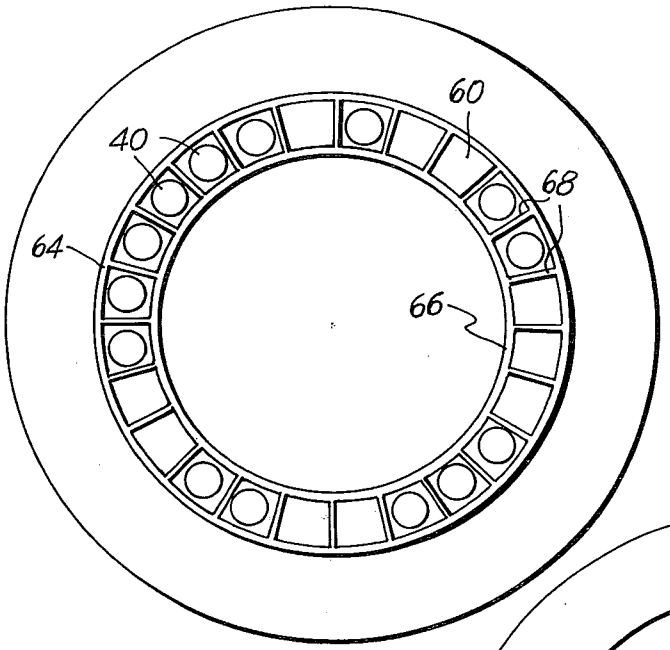

FIG. 7 is a view of the holder of FIG. 5 from the front.

Figure 8:
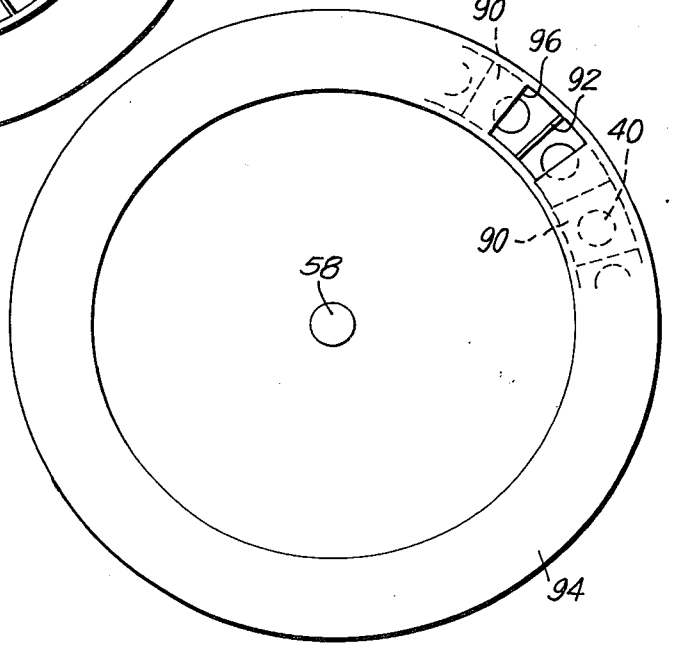

FIG. 8 is a view looking at the side of the holder, adjacent to the operating member of FIGS. 5 to 7, of the embodiment in accordance with FIG. 5.

Figure 9:
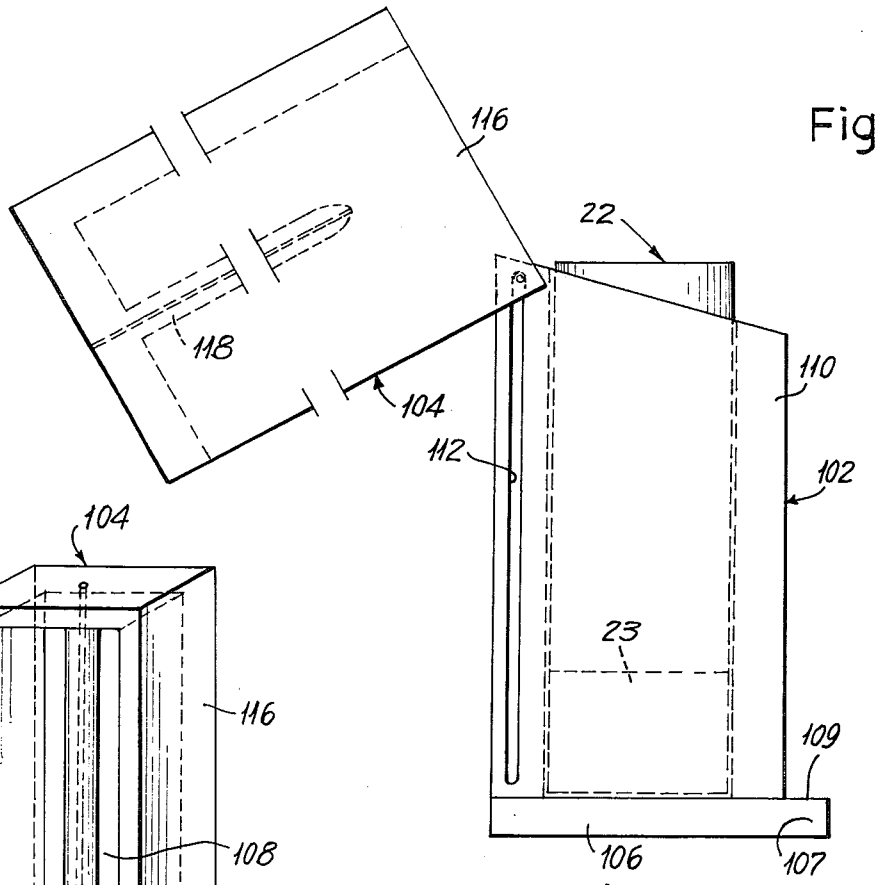

FIG. 9 is a perspective elevation of an embodiment in the case of which a mandrel consists of two cylinders having saw teeth at their front end and which can be rotated in relation to each other.

Figure 10:
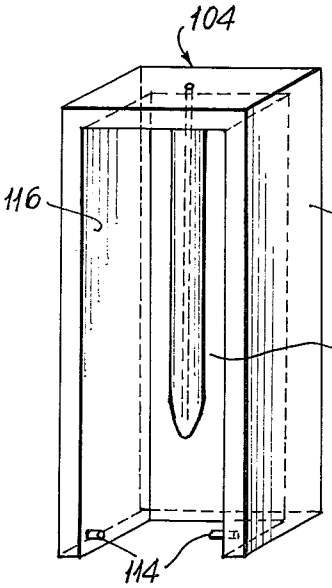

FIG. 10 is a perspective view of the operating member of the embodiment of FIG. 9.

Figure 11:
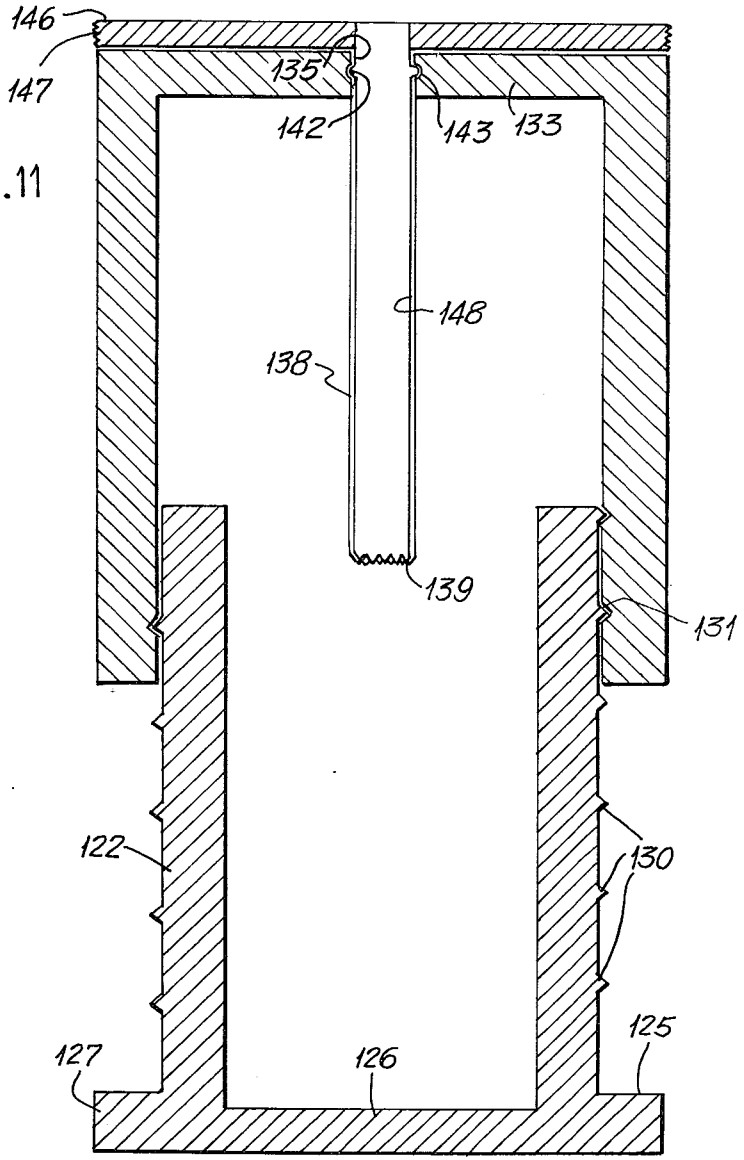

FIG. 11 shows an embodiment of the invention in the case of which a mandrel or punch consists of two cylinders having saw teeth at their front ends and which can be rotated in relation to each other.

Figure 12:
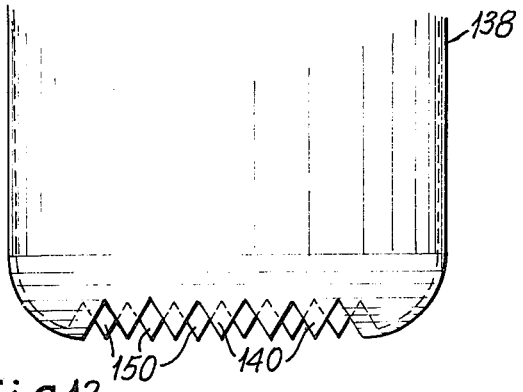

FIG. 12 is a side view of the mandrel of the operating member of the embodiment in accordance with FIG. 11.

Figure 13:
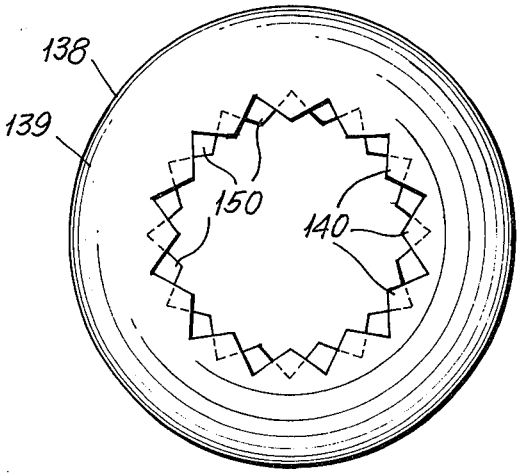

FIG. 13 is a plan view of the mandrel or the punch of the operating member of the embodiment in accordance with FIG. 11.

Figure 14:
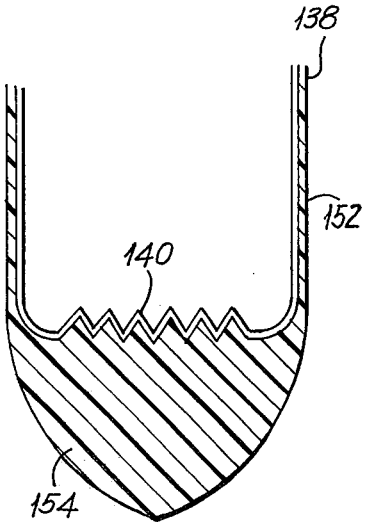

FIG. 14 is a cross-section through the mandrel or punch of the embodiment in accordance with FIG. 11 with an insert placed over it.

Figure 15:
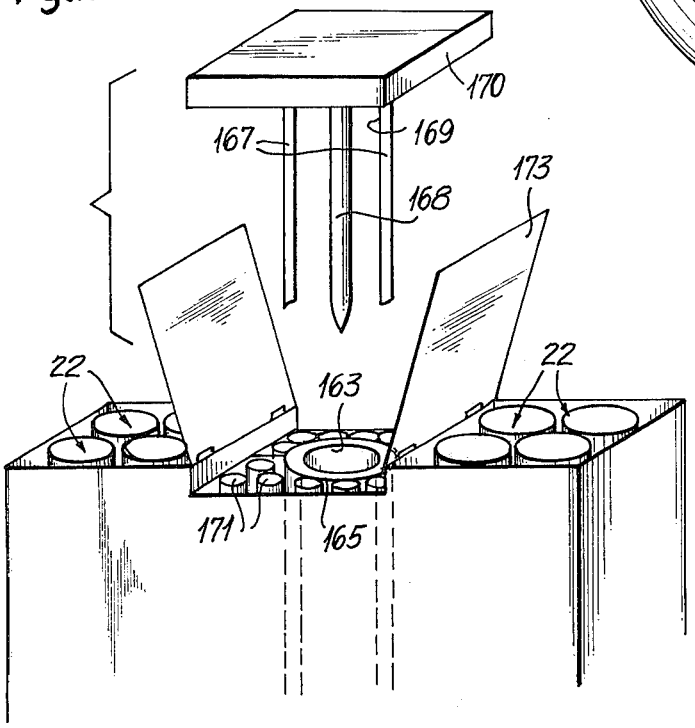

FIG. 15 shows an exploded view of another embodiment in the case of which the device in accordance with the invention is incorporated in a cigarette case.

Figure 16:
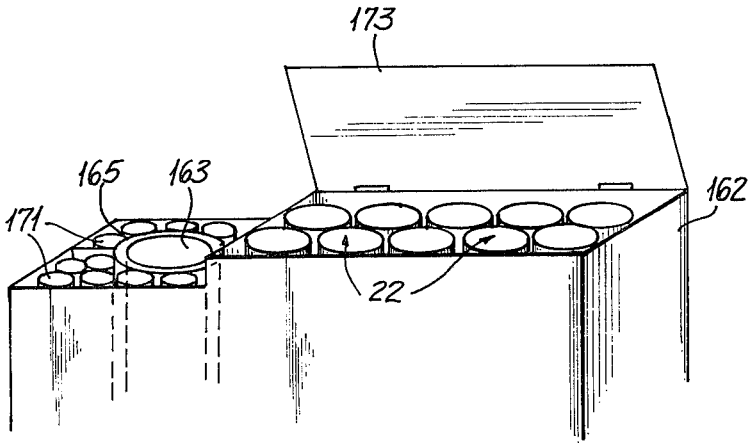

FIG. 16 shows an embodiment similar to that of FIG. 15.

Figure 17A:
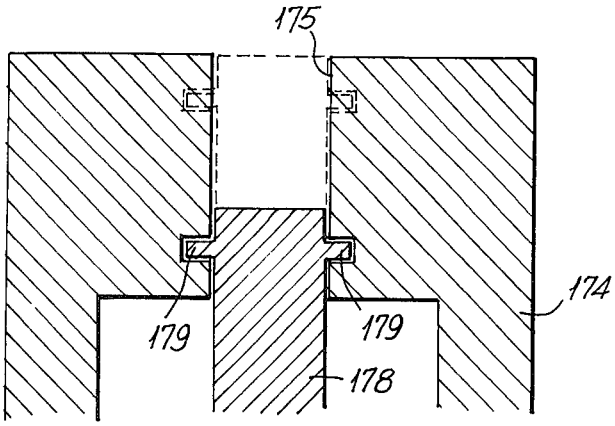

FIG. 17*a* shows a cross-section through the rear end of the operating member and a mandrel with two laterally projecting pins.

Figure 17B:
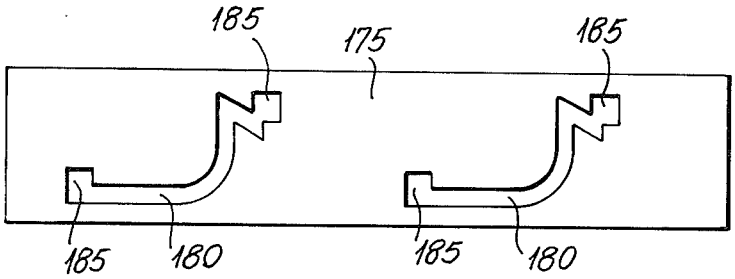

FIG. 17*b* shows a developed wall surface of the receiving opening in an operating member for the rear end of the mandrel.

Figure 18A:
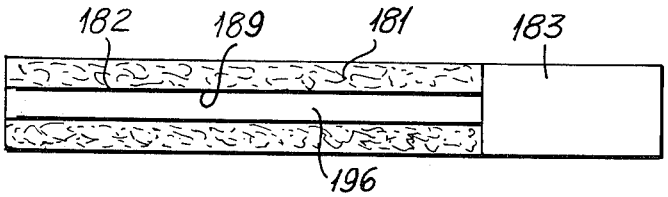

FIG. 18*a* shows a longitudinal section through a cigarette, which has a tobacco-free axial zone, which is partitioned off from surrounding tobacco by a double-walled tube.

Figure 18B:
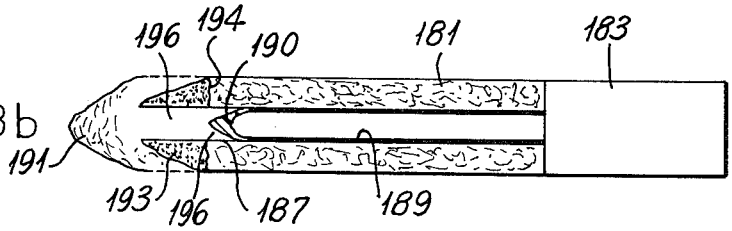

FIG. 18*b* shows a cross-section through the cigarette of FIG. 18*a* after the latter has been lit and a number of draws have been taken from it.

Figure 18C:
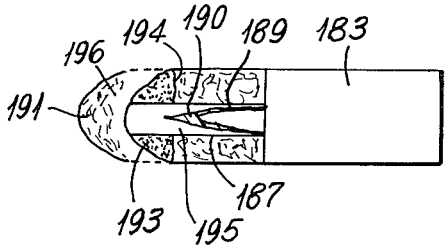

FIG. 18*c* shows a longitudinal section through the cigarette of FIG. 18*a* after the latter has been practically completely smoked.

Figure 19A:
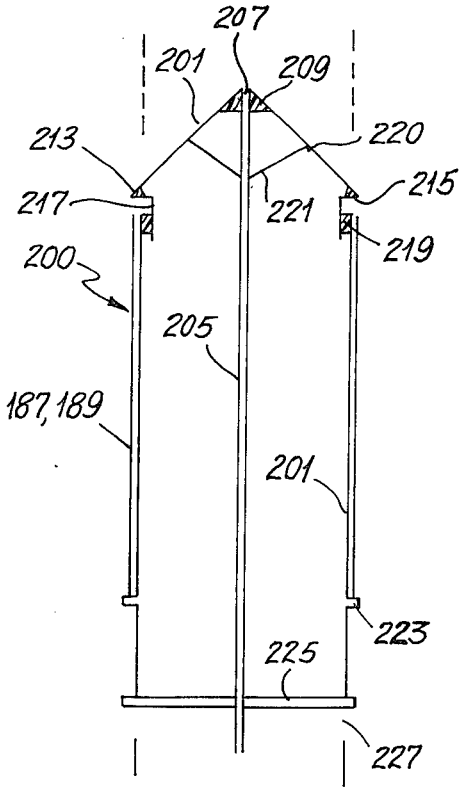

FIG. 19*a* shows a longitudinal section through a mandrel in accordance with a further embodiment of the invention.

Figure 19B:
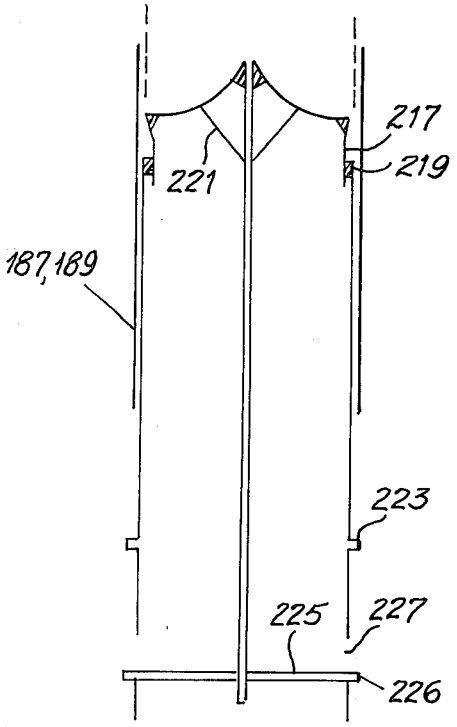

FIG. 19*b* shows a longitudinal section through the mandrel of FIG. 19*a* in the collapsed condition.

Figure 19C:
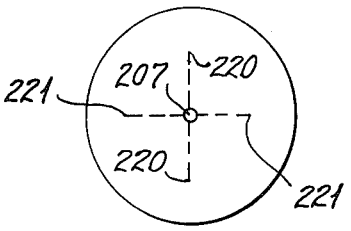

FIG. 19*c* shows a plan view of the mandrel of FIG. 19*a*.

Figure 19D:
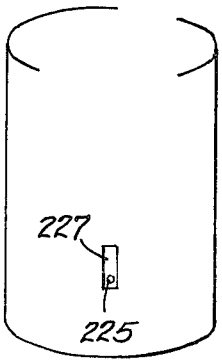

FIG. 19*d* shows an elevation of a part of the cylinder of FIG. 19*a*.

A particularly simple embodiment of the invention is shown in FIG. 1. This manual device 10 consists of a sleeve 12, which is open at one end shown at the top in FIG. 1 and at its rear end shown at the bottom in FIG. 1 it is closed or terminated by a rear wall 14. This rear wall 14 has a hole 16, through which a mandrel 18 can be introduced. At its rear end the hole 16 has a peripheral annular groove 20.

The diameter of the holder 12 is the same as the diameter of a commercially available cigarette 22, which is inserted with its front end first into the holder 12 so that the cigarette filter 23 is located at the upper, open end of the holder 12. This cigarette 22 is shown in elevation in FIG. 1, while the manual device 10 is shown in section.

As can be furthermore seen from FIG. 1, a mandrel 18 is inserted to the hole 16 into the cigarette. This mandrel 18 is fixedly connected with a pressure plate 24, which on its outer periphery is knurled at 26 so that it can be held more easily.

Adjacent to the pressure plate 24 the mandrel 18 has a peripheral ridge 28, which is constructed in a complementary manner to the annular groove 22. This peripheral ridge 28 cooperates with the annular groove 20 in forming a detent connection between the holder 12 and the pressure plate 14.

The annular wall of the holder 12 has at the front an inwardly oblique or chamfered end surface 30, which is to facilitate the introduction of cigarettes into the holder 12.

The side wall of the hole 16 and the inner end side 15 of the rear wall 14 of the holder 12 from a peripheral projection 32 which is directed towards the open end of the holder 12 and towards its longitudinal axis. This projection 32 serves as a stripper for inserts introduced into the cigarette, as will be described in more detail below.

In the side wall of the holder 12 chambers 34 are arranged. These chambers 34 are arranged generally in the form of a circle, as is represented in FIG. 2, which shows a cross-section through the manual device 10 along the line 2—2 of FIG. 1. These chambers 34 together form a magazine for the inerts to be introduced into the cigarette and which will be described in more detail below.

To the side and at the front end of the holder 12 these chambers 34 are surrounded by the holder itself. At their rear open ends the chambers 34 are covered by the pressure plate 24. This pressure plate has an opening 35, whose diameter is equal to that of the chambers 34. By turning the pressure plate around the longitudinal axis of the mandrel 18 connected with it, the opening 35 can be brought into alignment with any desired chamber of the chambers 34.

For filling the chambers 34 of the magazine the pressure plate 24 is turned and its opening 35 is brought into alignment with the individual chambers 34 one after the other so that in each case an insert can be introduced into one chamber 34. In FIG. 3 the pressure plate 24 is shown in a position in which its opening 35 is aligned with two segments of two adjacent chambers 34. It is therefore possible to fill all chambers 3 of the magazine and to hold them close by the pressure plate 24. Naturally in accordance with the particular dimension of the outer diameter of the holder 12 the chambers can also be made so large that in each case several inserts are arranged in one chamber.

The inserts to be introduced into the cigarette can be solid bodies, as is the case with the insert 38, shown in section in FIG. 4*a*, or can also be hollow bodies as is the case with the insert 40 which is shown in section in FIG. 4*b*. The insert 40 is shown in FIG. 4*c* in a side view, the continuous line and the interrupted line indicating a glued lap join 42.

The operation of the manual device 10 is extremely simple. Firstly the pressure plate 24 and simultaneously the mandrel 18 are drawn back to such an extent that the point 19 of the mandrel 18 is located inside the hole 16 of the rear wall 14. Following this a cigarette 22 is introduced with its front end first into the holder 12 to such an extent that its front end comes to lie against the inner end side 15 of the rear wall 14. The inner space of the holder 12 is so dimensioned that in this position described the rear end surface of the cigarette is aligned with the front edge of the holder 12 in a single plane. The user of the manual device 10 now places his finger transversely over the front end of the holder 12 and thus simultaneously prevents any longitudinal displacement of the cigarette in the holder 12.

The cigarette 22 is held against any rotation about its longitudinal axis by longitudinal ridges 13, which projects from the inner surface of the holder 12.

After the cigarette 22 has been held in this manner in the holder 12 so as to prevent rotary and longitudinal movement, the user presses on the pressure plate 24 so as to introduce the mandrel 18 into the cigarette 22 so that the tobacco is displaced out of the axial part of the cigarette 22 into the surrounding annular space. Since the cigarette makes close engagement with its outer surface against the inner surface of the holder 12 the filter paper of the cigarette cannot as a result be burst. In order to facilitate the introduction to the mandrel 18 into the central part of the cigarette 22 the pressure plate 24, whose edge is knurled at 26, can be rotated during its forward movement.

Following this the cigarette 22 can be removed from the holder 12 and in this respect the chamfered end surfaces 13 of the holder 12 facilitate grasping the cigarette 22. Naturally it is also possible to remove the mandrel 18 from the cigarette again before the cigarette is removed from the holder 12.

A solid insert 38 is introduced manually into the tobacco-free space left.

Naturally it is also possible, after displacement of the tobacco into the lateral annular space, to leave the cigarette 22 in the holder and to insert the insert 38 from the rear through the hole 16 of the rear wall 14 of the holder 12 into the space free of tobacco. After this insert 38 has already been inserted into the cigarette to such an extent that its rear end is aligned with the rear end face of the rear wall 14, the further introduction of the insert 38 can be carried out with the help of the mandrel 18. In order to facilitate this continuation of the introduction movement of the mandrel 18 into the cigarette 22 the rear wall 39 of the insert 38 is constructed so as to be complementary with respect to the front surface of the mandrel 18 as is shown in FIG. 4*a*.

The insert must be so constructed that on smoking a cigarette the air drawn in from the front always enters the incandescent zone substantially directly from the front and in this zone flows at the side adjacent to the tobacco-free space. If the latter is completely impermeable to air adjacent to the incandescent zone, the whole of the air drawn in from the front will flow past adjacent to the tobacco-free space. This happens if the insert 38 is completely impermeable to air and along its whole periphery makes snug engagement with the tobacco.

In order to achieve this effect the diameter of the insert 38 should not be smaller than the diameter of the mandrel 18 or should only be slightly smaller than it.

The shape of the insert 38 is not absolutely critical, that is to say it need not be as shown; for this reason the insert 38 of FIG. 4*a*, which is to consist of rolled paper, is represented so as to be slightly conical.

The described path of flow for the air drawn in at the front is however only ensured if a hollow insert, as is represented in FIG. 4*b*, is introduced into the cigarette. This insert 40 consists in the specific embodiment of paper, which is substantially impermeable to air and separates the tobacco-free space in a substantially air-tight manner from tobacco even when the latter is burning.

It is naturally to be understood that such a partition 40 will also be burnt on smoking the cigarette, something which is to be desired, since this partition can then fall away with the ash. It is however important that in the case of paper partitions the structure of the partition is initially preserved on smouldering and it is only in the ash zone of the cigarette that the partition should become impermeable to air. It has been found that the desired effect of reducing the amounts of noxious substances and more particularly of carbon monoxide also occurs if the partition is impermeable to air in the front part of the incandescent zone remote from the mouth-end of the cigarette. It is however necessary to ensure that air drawn in from the front cannot flow through the tobacco-free space in the longitudinal direction and then radially into the end zone of incandescence at the mouth-end, which in the case of normal cigarettes is also referred to as the reduction zone. Furthermore the partition should ensure that air drawn in from the front cannot flow through the tobacco-free space through the annular zone of the incandescent zone and between the incandescent zone and the mouthend into the annular tobacco space. An insert 40, which is constructed as a hollow body, and can therefore also be referred to as a partition, must therefore separate the inner surface of the incandescent zone, that is to say at least the third of the cylindrical inner wall, adjacent to the mouth, of the inner wall of the incandescent zone and the whole of the adjacent tobacco-free space in a substantially air-tight manner from the tobacco.

An exception will only apply if the insert 40 consists of a material with a high thermal conductivity as for example aluminum foil. In this case it is only necessary to have few small holes in the insert 40 which ensure a slight flow of air through the interior space and therefore a better cooling of the insert 40 and accordingly also of the incandescent zone.

If such a hollow insert 40 is to be introduced into a cigarette 22 the first step, as described above, is that of displacing the tobacco into the lateral annular space of the cigarette 22. Following this the mandrel 18 is completely withdrawn from the holder 12 and the insert 40, whose inner space is complementry with respect to the volume of the mandrel 18, is mounted on the latter. With the insert 40 mounted on it the mandrel is then introduced to the hole 16 of the rear wall 14 into the cigarette 22, which is again held by the finger of the user in the holder 12 so as to prevent displacement in the longitudinal direction. After in this manner the insert 40 has been introduced into the cigarette 22, the mandrel 18 is drawn out from the pressure plate 24 by pulling. When this is done the insert 40, if for example it consists of paper, is held to a greater degree on the tobacco than on the mandrel 18, which has a smooth surface. Even if the insert 40 adheres to a greater extent to the mandrel 18 than on the surrounding tobacco, on withdrawing the mandrel 18 it cannot be withdrawn from the cigarette 22 with the mandrel, since the edge of the insert 40 comes into engagement with the stripper 32. Therefore at the latest when the edge of the insert 40 is adjacent to the front end face of the cigarette 22 at the latest, it will be held by the stripper 32, while the mandrel can be completely withdrawn from the cigarette and therefore from the insert 40.

In order to enable the introduction of particularly thin walled inserts 40 readily into the cigarette 22, the interior space of the insert 40 should as far as possible be made complementary to the outer shape of the mandrel 18. It is just in such a case that there is however the tendency of the insert 40 to stick to the mandrel 18 as the latter is withdrawn, since between the front side of the mandrel 18 and the inner space at the end of the insert 40 a suction effect is produced on withdrawal. In order to prevent the build-up of such a suction effect an interior duct 21 can be provided, which extends along the whole length of the mandrel as is indicated in FIG. 1. Such a duct 21 facilitates both the donning of an insert 40 on a precisely fitting mandrel 18 and also the doffing of the insert 40, that is to say the withdrawal of the mandrel 18 from it. Such a duct 21 can be arranged centrally with respect to the mandrel 18. It is however possible to arrange a laterally offset air channel or also only a longitudinal groove in the mandrel 18.

The effect of such an insert 38 or 40 respectively as regards reducing the quantities of noxious substances in a cigarette can naturally only occur if the incandescent zone is adjacent to the insert during its movement on burning. If the insert only extends from the front end of the cigarette as far as its centre, it is only in the case of the first few draws or pulls on the cigarette that the effect reducing the amounts of noxious substances will be ensured. The insert should therefore preferably be so long that it extends from the front end of the cigarette through the whole length of the tobacco stick, which is normally smoked, so that in the cigarette end, which is not normally smoked, a piece of the insert will still remain. In the case of filter cigarettes the insert can preferably extend from the front end about as far as the end of the filter on the tobacco side. If the insert end adjacent to the mouthend of the cigarette does not extend precisely as far as the end of the filter adjacent to the tobacco and instead between the two a spacing of 3 or 4 mm is left, as a result the distribution of the sucked smoke transversely through the tobacco stick and over the end face of the filter adjacent to the tobacco will be facilitated so that despite the use of the insert the whole filter can exert its filtering action.

Naturally the reduction in the content of noxious substances is produced by such inserts not only in the case of filter cigarettes but also in the case of filterless ones.

This reduction in the content of noxious substances depends upon various parameters. One such parameter is the diameter of the insert. In the case of normal cigarettes with a diameter of 8 mm and a hollow insert extending along the whole length of the tobacco stick or strand and made of substantially airtight paper with an external diameter of 3 mm, reductions in the CO content in the smoke of 40 to 50% are obtained. This reduction effect increased with the external diameter of the insert. With inserts of the same diameter of aluminum foil CO reductions between 45 and approximately 60% were found; hollow inserts of aluminum foil with a few small holes in the foil cylinder or in the conical part of the insert led to CO reductions of up to 60%.

In the case of the use of hollow inserts of paper the reduction content in carbonmonoxide depended upon the paper porosity. With an increase in the paper porosity the reduction which could be obtained dwindled while in the case of a greater increase in the paper porosity the reduction was completely compensated for, that is to say cancelled out. It was in fact found that more CO was obtained on smoking such a cigarette than was the case with the smoking of a cigarette of the same brand which did not have any insert.

Such treated cigarettes however comprise not only less carbon monoxide but also, generally, less condensate, something which could be seen from the fact that the filters of smoked cigarettes which had such inserts were somewhat less strongly discolored than filters of the same cigarettes which had not been treated.

FIGS. 5 to 8 show another embodiment of the invention. This manual device for the production of cigarettes with low effective amounts of noxious substances consists mainly of a holder 52 and an operating member 54, which carries a mandrel 58 which can be introduced into the cavity of the holder and into the cigarette 22. The holder 52 has at its rear, closed end a laterally projecting flange 56, which forms a peripheral abutment 57 arranged perpendicularly with respect to the longitudinal axis of the holder. Within the holder a cigarette 22 with a filter 23 shown in elevation, while the remaining part of FIG. 5 is a sectional view.

The side wall of the holder 52 is again constructed so as to be so broad that it can be provided with internal chambers 60 which respectively serve for accommodating inserts 40. As will be gathered from FIG. 5 the chamber 60 is somewhat shorter than the longitudinal extent of the insert 40. This therefore projects at the upper edge so that at least a corner stands proud of the front wall 62, which is chamfered internally and externally, of the holder 52. As a result of the removal of the insert from the chamber 60 is facilitated. On the other hand the insert 40 cannot drop out of the chamber 60, since it is held by the holder 54.

The inner and outer chamfering of the front surface 62 of the holder serve on the one hand for facilitating introduction of the cigarette 22 into the internal space of the holder and on the other hand for facilitating the putting of the holder 54 in position.

FIG. 7 shows a plan view of the holder 52 in FIG. 5. In this view it can be seen that the holder consists of an outer wall 64 and a concentrically arranged inner wall 66, which together encompass an annular space. This annular space is subdivided by radially extending partitions 68 into chambers 60, in which inserts 40 or 38 can be arranged.

The holder 52 has on its outer surface a thread 63, which in order to make the drawing more readily intelligible is only shown in FIG. 6 representing an elevation of the holder 52. This thread mates with a complementary thread (not shown) provided on the inner periphery of the operating member, when the operating member 54 is placed on the holder 52. The operating member 54 is therefore screwed on to the holder 52. When this is done the mandrel 58 turns. The mandrel 58 is rigidly connected with the operating member 54. In this manner the introduction of the mandrel and the lateral displacement of the tobacco into the annular space of the cigarette is facilitated.

On the operating member 54 a pressure plate 70 is provided, which has generally the same diameter as the operating member 54. A pin 72 projects from the pressure plate 70 into a recess in the operating member 54 and this recess has a peripheral annular groove 74, into which there fits a ridge 75 extending around the pin 72. The annular groove 74 and the peripheral ridge 75 therefore cooperate in forming a detent connection between the operating member 54 and the pressure plate 70. The pin 72 has at its front end a pressure surface 76, which presses on a complementary pressure surface 78 of the operating member 54. These two pressure surfaces are constructed so as to offer as little friction as possible.

The embodiment described makes it possible to mount the operating member 54 initially only on the front end of the holder 52 and then press the operating member and the holder towards each other at oppositely placed ends. Since the pressure plate 70 can be rotated in relation to the operating member, the thread 63 on the outer wall 64 of the holder and the complementary thread (not shown) on the inner wall of the operating member 54 lead to a rotary movement of the latter while the pressure plate 70 is pressed towards the non-rotating holder 52. It is naturally also possible to use one hand to grasp the outer wall of the operating member 54 and to use the other hand to hold the flange 56 of the holder 52 and then to turn them in such a manner that they are screwed into each other. In this case using the embodiment shown rotary movement of the operating member and the holder will take place as the holder 52 and the operating member 54 are telescoped into each other. As a result the mandrel 58 will be continuously turned and moved into the cigarette 22 in the device.

In contrast to the embodiment of FIG. 1 in the case of an embodiment of FIG. 2 the cigarette is only held at the one end surface, that is to say at the end wall of the holder 52. This embodiment therefore makes it possible to make the side walls 64 and 66 so long that they extend for a few millimeters or even a centimeter beyond the front end wall of the cigarette. This embodiment of the invention thus makes it possible to modify cigarettes in accordance with the invention with any desired length. The device must only be so dimensioned that the length of the cavity within the holder is at least equal to or greater than the length of the cigarette 22 to be treated.

If the cigarette 22 is shorter than the length of the cavity within the holder 52, difficulties might arise as regards manually removing it from the holder 52, the insert having been placed in position; since a conventional cigarette has a diameter of 8 mm, the diameter of the cavity of the holder would also amount to 8 mm and as a result one could not use ones fingers to recover the cigarette. For this reason in the interior space of the holder 52 an ejector plate 80 is provided at the rear terminating wall, see FIG. 6. In this rear wall of the holder 52 a slot is arranged, which has generally the shape of a triangle and is indicated by the broken lines 82 and 84 in FIG. 6.

A pivoting lever 85, also shown in broken lines, is pivotally connected with the ejector plate 80 and 81. This pivoting lever has a cranked section 86 which projects horizontally into a trough 88, which is arranged in the rear end wall of the holder 52. In the normal position the ejector plate 80 lies against the inner terminating wall of the holder 52 and simultaneously the pivoting lever 85 lies against the wall 84 of the slot and the cranked section 86 of the pivoting lever 85 projects into the trough 88, as is represented in the figure. In this position the pivoting lever 85 is snapped into position so that it normally remains in this position.

If the cigarette is to be ejected, the end of the cranked section 86 of the pivoting lever 85 in the groove 88 is retracted with a finger or the nail of a finger and as a result the pivoting lever 85 is swung out around the slot wall 82 running generally parallel to the longitudinal axis of the holder 52. As a result the outer wall 86 extends to the rear away from the holder 52. By means of pressure on the pivoting lever 85, 86 the latter is pushed forwards and owing to the pivot point 81 it also moves the ejector plate 80 and accordingly the cigarette 22 lying in the holder 52 forwards. As a result the cigarette 22 can be caused to project to such an extent that it extends clear of the front edge 62 of the holder 52 and the user can grasp it with his fingers and pull it out. The cranked section 86 is made broader than the slot in the rear wall of the holder 52. For this reason the pivoting lever 85 in the swung out position can only be pushed into the holder in such an extent that the cranked section 86 comes to lie against the rear side of the rear wall. In this manner it is possible to ensure that the ejector plate cannot fall out of the holder 52.

In the case of the embodiment of FIG. 5 a magazine is formed not only in the holder 52 but also in the operating member 54 and partitioning of the magazine is ensured by radially extending partitions 92.

These chambers 90 are terminated by a rotatable lid 94, which has an opening 96, whose area is equal to the cross-sectional area of the chambers 90. This lid 94 is mounted on the operating member 54, see FIG. 5. A peripheral sleeve extends from the lid 94 towards the pressure plate 70. This sleeve 98 carries an internally arranged annular ridge 97, which fits into a circular groove 95 on the outer wall of the operating member 54.

This ridge 97 therefore provides a detent connection between the lid 94 and the annular groove 95 of the operating member so that the lid 94 can be turned in relation to the operating member 54 but does not drop off. On rotation of the lid 94 its opening 96 can be aligned with anyone of the chambers 90 so that the inserts 40 can be placed in the chambers 90 and then later removed.

FIGS. 9 and 10 show a further embodiment in the case of which a holder 102 and a operating member 104 are connected together so as to be able to move in relationship to each other. The operating member 104 carries a mandrel 108.

FIG. 9 shows a side elevation of this embodiment in the case of which the holder 102 and the operating member 104 each have a rectangular cross-section. The holder 102 has a foot 106, which has a flange 107 projecting to the front and to the sides. The upwardly facing surface 109 of the flange 107 forms an abutment for the lower edge of the operating member 104. At their upper ends the side walls 110 of the holder 102 are chamfered or made oblique; these side walls thus extend from the front side of the holder 102 to its rear side, as is represented in FIG. 9. Owing to this embodiment it is possible to ensure on the one hand that the cigarette 22 located in the holder projects at least in its front part beyond the upper edge of the side walls 110 and above the upper edge of the front wall; it can therefore be more easily grasped with the fingers and drawn out.

In the rear part of the side walls 110 a groove 112 is formed, which extends from the foot 106 of the holder as far as the upper rear edge zone of the side wall 110 generally parallel to the longitudinal axis of the holder, see FIG. 9.

Guide pins 114, which project from the side walls 116 of the operating member 104, extend into these grooves 112, see FIG. 10. These pins are constructed integrally with the side walls in their lower rear part or can be connected with them fixedly in a non-integral construction.

As will be seen in FIG. 10 the operating member 104, whose clearance width must correspond to the external cross-section of the holder 102, can be constructed without a rear wall. This offers the advantage that these corners of the side walls 116 can be shaped so as to bend away from each other and as a result the pins 114 can be placed in position from the rear or from above into the grooves 112 of the holder 102.

The operating member 104 can in the case of this embodiment be placed in position on the holder 102 from above. Its lower or completely mounted position is defined by the abutment of its lower edge on the flange 109 of the foot 106.

For introducing a cigarette 22 into the holder 102 the operating member 104 is firstly moved into its upper end position, that is to say so that the pins 114 abut against the upper end of the guide grooves 112, and following this the operating member 104 is swung away clear of the holder 102, that is to say to the left in terms of FIG. 9. This pivoting movement can comprise a displacement of nearly 180°, since the operating member does not have any rear wall. Accordingly the opening of the holder 102 is completely cleared so that the cigarette 22 can be introduced into it without any impediment. The pivoting movement of the operating member 104 is facilitated by the fact that the side walls 110 of the holder 102 are made oblique at their upper ends so that the front wall of the holder 102 is smaller than its rear wall. For this reason the operating member 104 can be swung away to the rear even when it is not been completely moved into its upper end position. Naturally this embodiment can also be so modified that a magazine for receiving inserts can be provided in or on the holder or the operating member.

The manual devices so far described each have a mandrel, which for the modification of cigarettes displaces the tobacco in such cigarettes out of the zone adjacent to the longitudinal axis. The embodiment so far described therefore modified cigarettes without changing the amount of tobacco. Since such tobacco is laterally displaced the density of the tobacco in the annular tobacco space around the insert is increased and accordingly the resistance to flow or drawing is increased in the case of modified cigarettes. While it is true that this modification in the resistance to draw is only slight, there will be some smokers who are so accustomed to the brand of cigarette which they always smoke that they would find even slight changes in the resistance to draw as strange and undesirable. Such smokers will therefore prefer a manual device for reducing the effective content of noxious substances in cigarettes, which makes possible the introduction of inserts 38 or 40 in accordance with the invention without increase, or at the most only without a substantial increase, in the resistance to draw of the cigarette. Such an embodiment of the invention is shown in FIGS. 11 to 14 and will be described in what follows.

FIG. 11 shows a sectional view of such a manual device. The device consists of a holder 122 and an operating member 124. The holder again has a foot 126 with a peripheral projection 127, whose surface 125, adjacent to the operating member, has an abutment for the operating member 124. On the outer side of the holder a thread 130 is provided, which is constructed so as to be complementary to a thread 131 provided on the inner wall of the operating member 124. From the upper terminal wall of the operating member 124 there projects, as is similar to the mandrels in the case of the operating members of the embodiments described supra, a rigid tube 138 into the interior space of the operating member 124. This rigid tube is rigidly connected with the operating member 124 so that it takes part in its longitudinal and rotary movements. This rigid tube 138 is represented in an enlarged elevation in FIG. 12 and is shown from below in FIG. 13, that is to say looking towards the terminal wall of the holder 122. On examining these figures it will be seen that the tube 138 has a rounded part 139 at its lower end and this part 139 bears a ring of cutting or saw teeth 140. These saw teeth are directed obliquely downwards and towards the longitudinal axis of the operating member.

In this outer tube 138 and concentrically with respect to the latter an inner tube 148 is arranged which is slightly spaced from the inner wall of the outer tube 138. This inner tube 148 has a shape similar to that of the outer tube 138. At its lower end it also has a rounded portion 149, which is constructed so as to be parallel to the rounded portion 139. This rounded portion 149 also bears a ring of cutting or saw teeth 150, whose teeth make surface engagement with the teeth of the ring 140 of saw teeth.

This inner tube 148 is however not fixedly connected with the operating member 124 and instead can be turned in relation to the latter and also in relation to the outer tube 138.

This holding arrangement is made possible by the fact that the operating member 124 has in its terminal wall 133 a through hole 135, in which the inner tube 148 is arranged so that it can rotate. This tube 148 has adjacent to its upper end a peripheral projecting ridge 142, which fits into an annular groove 143, which for its part is formed in the wall of the hole 135. This ridge 142 cooperates with the annular groove 143 forming a detent connection between the inner tube 148 and the operating member 124.

At its upper end the tube 148 is fixedly connected with the pressure plate 146, whose diameter is equal to that of the operating member 124. At its periphery this rotary plate 146 is knurled at 147. On rotating this plate 146 the inner tube 148 can be turned. As a result its saw teeth 150 rotate in relation to the saw teeth 140 of the outer tube 138. As a result any tobacco located between the saw teeth of the two tubes will be chopped up, as can be seen with reference to FIGS. 12 and 13.

This embodiment as shown in FIGS. 11 to 13 operates as follows: A cigarette is placed in the holder 122 with the filter at the bottom end if should be a case of a filter cigarette. The operating member 124 is then moved down on to the holder 122. On pressing from below on the foot 126 and from above on to the pressure plate 146 the holder and the operating member are caused to telescope into each other, the operating member 124 caused to rotate owing to the positive action of the thread 130, 131. As a result the teeth 140 of the outer tube 138 are forced to rotate in relation to the teeth 150 of the inner tube 148. On moving these tubes into the cigarette the rounded part 139 of the tube 138 will displace tobacco from the central part into the annular space. The tobacco which is directly located in front of the tube 138 will firstly be compressed and then partly comes between the teeth 150 and 140. Owing to the relative movement between these rings 150 and 140 of the teeth the tobacco located between them will be chopped up so that a narrow tobacco strand will be cut out of the axial part of the cigarette, which is then forced into the bore of the inner tube 148.

On placing the operating member 124 on the holder 122 and on simultaneously introducing the tubes 138 and 148 into the cigarette a part of the tobacco is therefore cut out of the central part of the cigarette. In order to reinforce this cutting action the rotary plate 146 can be turned in a direction opposite to the operating member 124 when pressing on the latter so that the relative speed of the saw teeth 150 with respect to the saw teeth 140 is increased still further and the cutting action is improved. On removing the tubes 138 and 148 from the cigarette the tobacco which has come to lie in the bore of the inner tube 148 will be removed as well. The cigarette will therefore comprise less tobacco than before.

The tube 138 serves, just like the mandrels of the embodiments described supra, simultaneously for introducing an insert 152 into the cigarette.

This insert 152 is shown in FIG. 14. Since the cylinder 138 and also the cylinder 148 have sharp teeth it it necessary to ensure that these teeth cannot cut the insert after introduction into the cigarette, since the insert would in this case become permeable to air. Such a leaking insert would however not bring about the desired reduction in the content of noxious substances and more particularly carbonmonoxide, as described supra. For this reason the conical part of the insert 152 is provided at least in its upper part with a filling of soft composition 154, which adapts itself to the shape of the cutting teeth 150 and 140. These teeth can therefore not damage the insert 152.

In accordance with another embodiment of the invention the manual device for the production of cigarettes with a low effective content of noxious substances need not to be limited to separately constructed instruments with only one single purpose, that is to say the modification of cigarettes. As can be seen in FIGS. 15 and 16 such a manual device can also be arranged in a cigarette case 162. In the case of this embodiment of FIG. 15 the manual device is arranged in the centre of the case 162. Concentrically with respect to the wall 163 of the holder a further wall 165 is provided spaced from the holder. The wall 165 defines an annular space with the holder wall 163. This annular space serves for receiving the cylindrical wall 167 of the operating member, which is shown in the exploded view above the case and this wall 167 can again have a thread 169 on its inner side, which is constructed so as to be complementary with respect to a thread (not shown) on the inner wall of the cylindrical holder wall 163. Naturally the operating member wall 167 can also have a thread on its outer wall which must then be complementary with respect to a thread on the inner wall of the further wall 165. A mandrel 168 again projects into the operating member, the mandrel being attached to the lid 170. The operating member wall 167 and the mandrel 168 are connected with each other in such a manner as to prevent relative rotation, while the two are constructed so as to be able to rotate in relation to the lid 170; in order to make the drawing more readily understood this rotatable holding is not shown in FIGS. 15 and 16. Inserts 171 are arranged around the further wall 165, which are to be inserted into a cigarette. The lid 170 should serve that part of the case 162 which accommodates the manual device and the inserts, when the operating member is completely mounted on the holder.

On both sides of this part of the manual device spaces are provided for accommodating the cigarette 22. These two spaces can be closed by pivoting lid 173.

FIG. 16 shows an embodiment of the invention which is similar to that of FIG. 15. In this case 162 as well a manual device is arranged for producing cigarettes low in noxious substances but in this case the arrangement is on one side and not in the middle. The corresponding parts of this embodiment are given the same references as the corresponding parts of the embodiment of FIG. 15.

Cigarettes differ both as regards the total length and as regards the length of the filter section. An embodiment of the invention which makes possible the production of cigarettes with lower amounts of noxious substances having different lengths is shown in FIG. 5. Since the length of the cavity in the holder is larger than the length of the longest cigarette which can be obtained commercially, it is therefore possible to modify all commercially available cigarettes with this manual device in order to produce cigarettes low in noxious substances. In this case the mandrel 58 penetrates in each case as far as an equal distance from the filter 23 of the cigarette 22 independently of the length of a cigarette providing that the cigarette has the same length in each case.

FIGS. 17*a* and 17*b* show an embodiment of the invention which makes possible a control of the depth of penetration of the mandrel so as to achieve the same spacing from filters with different lengths.

FIG. 17*a* shows a cross-section through a part of the rear section of a operating member 174 and the rear section of a mandrel 178. The operating member has a round opening 175, into which the mandrel 178 penetrates. The wall of this opening 175 is represented in FIG. 17*b* in a developed view. As will be seen diametrally opposite, identical grooves 180 are arranged in the wall 175. The diameter of such grooves is so dimensioned that the pins 179 fit into them, which project from diametrally opposite points of the mandrel 178. On turning and sliding the mandrel 178 the latter can be moved into its lower end position and by means of its pins 179 can be fixed in this position in the lower end 183 of the grooves 180. In this position the mandrel 178 is shown in FIG. 17*a* by the use of full lines. This mandrel 178 can however also be moved by turning and sliding into its upper position and arrested at this position, as is shown by the broken lines of FIG. 17*a*. In this upper end position the pins 179 lie in the arresting ends 185 of the grooves 180.

This possibility for changing the position of the mandrel 178, only represented diagrammatically, in relation to the operating member 174 serves for adapting the manual device to cigarettes with different filter lengths with the purpose of inserting the inserts for the same distance with respect to the end surface of the filter adjacent to the tobacco. The distance between the upper and the lower position of stopping of the mandrel 178 corresponds in this respect to the different lengths of the filters of various brands of cigarettes.

This possible modification was described with reference to a mandrel but however it can also be used in a similar manner for tubes of which one surrounds the other, with front end saw tooth rings, which remove tobacco from the cigarette to be modified.

It has been found that the content of carbon monoxide is also increased in the smoke of cigarettes substantially in cases in which a tube is arranged in the axial part of a cigarette and which is initially open at the front and rear ends and which under the influence of the incandescent zone becomes sealed laterally adjacent to the incandescent zone, and also in the longitudinal direction, in a substantially air-tight manner. Such a cigarette is represented in FIGS. 18*a*, 18*b* and 18*c*.

FIG. 18*a* shows a section through a filter cigarette, whose tobacco is exclusively located in the tobacco space 181, which extends from the front end of the cigarette as far as the filter 183. The annular tobacco space 181 is separated from the tobacco-free zone 185 adjacent to the axis by a double-walled tube, which consists of an external tube 187 of paper and an inner tube 189 of plastics. The two tubes 187 and 189 are closely adjacent to each other so that no air can flow through between them.

FIG. 18*b* shows this cigarette after partial smoking as can be seen for example from the ash cone 191 shown on it. The external partition tube 187 consists chiefly of air-tight, dimensionally stable paper; it remains substantially air-tight in the incandescent zone 193 as well at least to a large extent, as is indicated in FIG. 18*b*. The inner tube 189 consists in the embodiment shown of a plastics, which under the action of the incandescent zone 193 is continuously melted at the front end so as to provide a seal on smoking and forms a substantially air-tight termination 190. This termination is located in the part between the end surface 194 of the incandescent zone 193 on the mouth side and the filter 183. The precise position of this air-tight seal 190 in relation to the incandescent zone 193 is not critical, since the closure only has to be air-tight in the longitudinal direction. The sealing action in a radial direction outwards towards the annular tobacco space 181 is brought about by the partitioning tube 187, which also at least in the greater part on the mouth side of the incandescent zone remains substantially air-tight.

Naturally no air should initially be allowed to flow beside the termination 190 between the partitioning tube 187 and the inner tube 189. This inner tube is therefore to make air-tight engagement with the inner wall of the partitioning tube 187.

As is also represented in FIG. 18*b* many plastics, which are initially constructed as an inner tube 189 and which on smoking are sealed at the front end, will assume a conical shape at their front or outer end. Between the termination 190 which is continuously being formed and the partitioning wall 189 an annular gap 195 is accordingly produced which however does not give rise to any difficulties since it only extends for a few millimeters from the external tip of the termination 190 towards the mouth end of the cigarette. At least at the beginning of smoking the partitioning tube 187 and the inner tube 189 make an air-tight engagement with each other behind this position.

On the other hand there are a large number of plastics which shrink under the action of heat. If the inner tube is made of such a plastics on smoking an annular gap will be produced between the two tubes, whose length in the longitudinal direction of a cigarette will be larger than is the case with the embodiment of FIG. 18*b*. Even if such an annular gap should be 20 mm in length, the tobacco-free space 196 will still remain air-tight as long as the external tip of the termination 190 which is continuously being formed is located more than 20 mm from the end face of the filter adjacent to the mouth of the smoker.

This property of many plastics materials of shrinking under the influence of heat can however be used as is shown in FIG. 18*c*. In the case of this cigarette the incandescent zone 193 has already come up very close to the filter 183. The termination 190 which is continuously being formed is however in the case of this embodiment located in the part of the incandescent zone 193 which is closest to the mouth end of the cigarette. The annular gap 195 however, whose diameter decreases towards the filter 183, extends as far as the end face of the annular tobacco space 181 adjacent to the mouth of the smoker. At this transition as well from the annular tobaceo space 181 to the filter 183 a peripheral space or gap is formed between the partitioning tube 187 and the inner tube 189 and this gap allows the direct passage of external air through the tobacco-free space 196 into the filter 193. The more the cigarette is smoked the larger the size of the gap 195, since the radial extent of this peripheral annular space widens out towards the incandescent zone 191, this also being because this annular gap 195 moves towards the filter 183. The more the cigarette is burnt away the more external air can be directly supplied. This phenomenon is extremely desirable since owing to the increasing direct supply of external air through the tobacco-free space 196 the noxious material gradient, which increases considerably as the residual length of the cigarette becomes shorter and shorter is partly or fully outweighed or can in fact be more than outweighed, that is to say owing to the admixture of fresh air.

In accordance with a further development of the invention such double-walled tubes 187, 189 can also be encorporated in cigarettes. A corresponding modification of such an embodiment is represented in FIGS. 19a to 19d and will be described in what follows.

FIG. 19*a* shows a cross-section through a mandrel 200, which can be introduced into a cigarette and when this is done laterally displaces the tobacco out of the zone adjacent to the axis.

This mandrel consists of a rigid hollow cylinder 201, on whose front end a generally conical or conically pointed part 203 is attached, which consists substantially of plastics. In the mandrel 200 there is a hollow punch 205, which has a continuously extending air duct 207 and at its front end is connected with the conical part 203.

The conical part 203 consists of flexible plastics. The front part is constructed with very thick walls for reinforcement or has a filling 209. The casing surface 201 is very thin-walled and readily flexible. The surrounding edge at the lower end of the cone 203 again has a thickening. Furthermore it is rounded off as is represented at 215. From the lower periphery 215 the front part 203 extends radially inwards and is then continued as a sleeve 217, which makes concentric internal engagement with the rigid cylinder 201 and it is connected with it at the strip 219, for example using adhesive or another suitable manner.

On the flexible casing 211 at four positions 220 bands or tapes 211 are attached, which have their other ends connected with the punch 205. These bands 221 are drawn taut when the punch 205 is located in its front end position as is shown in FIG. 19*a*. In this position the front part 203 is drawn into its conical shape. In this respect the rounded edge 215 extends so far beyond the outer periphery of the rigid cylinder 201 that it projects laterally also beyond the double-walled tube 187/189 consisting of a plastics tube 187 and a partition tube 189. The tube 187/189 is only indicated by one line. This rounded lower edge 215 ensures that on introducing this mandrel 200 into a cigarette the double-walled tube 187/189 does not jam against tobacco crumb at its front edge.

On the other hand the double-walled tube 187/189 can be displaced to the rear owing to sticking to the tobacco on the rigid cylinder 201, when the mandrel 200 is introduced into a cigarette. In order to prevent such displacement a ridge 223 projecting to the outside is arranged around the cylinder 201 and this ridge holds the double-walled tube 187/189 in its position.

In order to draw the mandrel 200 out of the double-walled tube 187/189, after the latter has been introduced into a cigarette, the edge 215, which extends laterally beyond the double-walled tube 187/189, must be moved radially inwards. This is done by drawing the punch 205 to the rear. When this is done the bands 221 draw the casing 211 at the four points 220, see FIG. 19*d*, inwards, as is represented in FIG. 19*b*. As a result also the lower edge 215 is drawn so far towards the longitudinal axis of the mandrel 200 that it is located within the extension of the rigid cylinder 201, see FIG. 19*b*. After the punch has reached this position in relation to the cylinder 201 it is convenient to avoid a further tug at the points 220 of the casing 203, as otherwise the connection between the cone 203 and the rigid cylinder 201 might be broken at 219. In order to prevent a further relative movement of the punch 205 in relation to the cylinder 201 in a downward direction, the lower part of the punch carries several radially outwardly extending pins, whose ends 226 extend through slots 227 arranged in the rigid cylinder 201. These slots 227 are so arranged and so dimensioned in their lengths that the pins 225 make engagement with the lower edge of the slot 227, see FIGS. 19*b* and 19*d*, in the extreme lower position of the punch 205, and that the pins make engagement with the upper edge of the respective slot in the upper extreme position of the punch 205, see FIG. 19*a*. These extreme positions are however only to be understood as regards the position of punch pin 205 with respect to the cylinder 201.

After a double-walled tube 187/189 has been introduced into a cigarette, the mandrel 200 is removed from the cigarette by a continuous pull on the punch 205, and it is also removed from the double-walled tube 187/189 remaining in the cigarette.

At the beginning of this movement of the punch 205 initially no pull is exerted on the cylinder 201, and instead a pull is only exerted on the cone 203, that is to say directly via the attachment of the cone at the front end of the punch 205 and on the other hand via the bands 221. As a result the cone collapses as is represented in FIG. 19*b*. When the punch is moved in relation to the cylinder 201 and reaches its extreme position shown in FIG 19, its pins 226 lie against the lower edge of the respective slot 227. In the case of a further downward movement of the punch 205 the pull on the punch is transmitted to the cylinder 201 so that the latter begins to move in relation to the double-walled tube 287/189 and is completely drawn out of it.

Following this the mandrel can be inserted into the next cigarette in order to modify it. For this purpose the front cone 203 is fully extended on pushing on the push rod 205, since the punch 205 moves forwards without transmitting any force to the cylinder 201. After the unfolding or development of the cone 203, that is to say after the pins 226 come to lie against the upper edge of the slot 227, the forward movement of the punch 205 is transmitted to the cylinder 201. In this condition the mandrel 200 can displace tobacco out of the axial zone into the lateral parts of a cigarette into which the mandrel 200 is introduced.

Following this the mandrel 200 is withdrawn from the cigarette in the manner described, the front part 203 collapsing again. In this condition a double-walled tube 187/189 can be pushed on to the mandrel 200 from the front and then the mandrel can be inserted into the cigarette with the double-walled tube 187/189 placed on it.

The arrangement of this mandrel and its attachment to an operating member can be in any suitable manner, for example as in accordance with the specific embodiments described above.

In order to increase its stability the punch 205 can be naturally be made substantially broader, at least in its lower part while its overall diameter can be somewhat smaller than the internal diameter of the rigid cylinder 201.

We claim:

1. A portable manually actuated device for modifying preformed tobacco articles to render the tobacco articles with a low carbon monoxide content, comprising:

a substantially tubular holder having a tobacco article-receiving opening for receiving therein the entire length of the tobacco article, said tubular holder comprising a cylindrical base, a tubular holding portion extending from said base, said holding portion having an inside diameter allowing snug holding of a preformed tobacco article, an outside diameter which is smaller than the diameter of said base, a length which is sufficient to substantially receive the entire length of said preformed tobacco article; and tobacco displacement means extending cooperatingly with respect to said tobacco article receiving end into said tubular holder, said tobacco displacement means comprising a tubular member having a closed end and an open end, side walls forming an outside diameter and an inner diameter approximately equal to the diameter of the outside diameter of said tubular holder, whereby said tubular member is adapted to telescopically slide at its open end over said tubular holder at its end having the tobacco article-receiving opening, a tobacco displacing mandrel centrally arranged inside of said tubular member, said mandrel extending at a length which is less than the length of the preformed tobacco article and having an effective thickness sufficient to provide a tobacco-free longitudinal space congruent with the central longitudinal axis of said preformed tobacco article upon removal of said displacement means from the tobacco article, and wherein said tubular holder comprises a helical thread on its outer diameter, said tubular member of said tobacco displacement means comprises a cooperating helical thread on its inside diameter, whereby said tobacco displacement means is caused to rotate with respect to said tubular holder when the two are longitudinally moved in telescoping arrangement.

2. A device in accordance with claim 1, wherein said tobacco displacing mandrel comprises two tubes which are arranged one inside the other and can be turned in relation to each other and which at their front end have cooperating rings of cutting teeth, and wherein one tube is connected with said tubular member in a manner preventing relative rotation, while the other tube is rotatable in relation to said tubular member.

3. A device in accordance with claim 2, wherein the inner tube extends through an opening in the closed end of said tubular member and is rigidly connected with a rotary plate and the rotary plate is arranged behind said closed end of said tubular member in such a manner so as to be able to rotate in relation to said tubular member.

4. A device in accordance with claim 3, wherein the wall of the opening in the closed end of said tubular member comprises an annular groove and said inner tube comprises an annular projection cooperating with said groove to form a rotating detent connection.

5. A device in accordance with claim 2, wherein the outer tube and the inner tube are rounded off inwardly at their front ends and their rings of cutting teeth are directed obliquely inwardly and obliquely forwardly.

6. A device in accordance with claim 1, wherein the mandrel comprises an air pressure equalizing duct extending along its entire length.

7. A device in accordance with claim 1, further comprising means for adjusting the length of said mandrel.

8. A device in accordance with claim 7, wherein said mandrel extends through a cylindrical opening in the closed end of said tubular member, said cylindrical opening comprises two diametrally opposite grooves which define respective longitudinally spaced front and rear end positions, and said mandrel includes at its base pins which extend from the mandrel at diametrally opposite points, which pins engage in said grooves and can be guided between said front end position and said rear end position.

9. A device in accordance with claim 1, further comprising at least one magazine, comprising a longitudinal chamber constructed in the side wall of said tubular holder, for receiving an insert adapted for incorporation into the tobacco-free space formed in the tobacco article.

10. A device in accordance with claim 9, further comprising at least one magazine, comprising a longitudinal chamber constructed in the side wall of said tubular member, for receiving an insert adapted for incorporation into the tobacco-free space formed in the tobacco article.

11. A device as defined by claim 10, wherein said tubular member further comprises:

an annular lid rotatably secured to the end of said tubular member opposite said closed end thereof, said lid having at least one opening which cooperates with said longitudinal chamber in said tubular member and will permit passage therethrough of said inserts from said magazine upon rotation of said lid.

12. A device as defined by claim 9, wherein said lid comprises:

a generally planar lid base;

a sleeve extending upwardly from said base so as to encase the outer diameter of said tubular member;

an annular groove on the outside wall of said tubular member; and a ridge formed on the inner diameter of said sleeve cooperating with said annular groove in the outside wall of the tubular member.

13. A device in accordance with claim 1, wherein said mandrel comprises at its front end a body, which is constructed so as to expand and contract and which in its expanded condition generally has the shape of a cone wherein the rear section of the cone extends on all sides beyond the outer periphery of the shank of the mandrel, and which in its contracted condition has a circumference smaller than the outer periphery of the mandrel shank, and wherein said mandrel further comprises means for selectively expanding and contracting said body.

14. A portable manually actuated device for modifying preformed tobacco articles to render the tobacco articles with a low carbon monoxide content, comprising:

a substantially tubular holder having a tobacco article-receiving opening for receiving therein the entire length of the tobacco article, said tubular holder having an inside diameter adapted for snuggly holding the tobacco article and comprising a plurality of longitudinally extending, inwardly projecting ridges on the inside surface thereof, said ridges being adapted to prevent the tobacco article from rotating within said holder; and tobacco displacement means extending cooperatingly with respect to said tobacco article receiving end into said tubular holder, which displacement means includes a mandrel having a conical end and has an effective length which is less than the length of the preformed tobacco article and an effective thickness which will provide a tobacco-free longitudinal space congruent with the central longitudinal axis of said preformed tobacco article upon removal of said displacement means from the tobacco article.

15. A portable manually actuated device for modifying preformed tobacco articles to render the tobacco articles with a low carbon monoxide content, comprising:

a substantially tubular holder having a tobacco article-receiving opening for receiving therein the entire length of the tobacco article;

tobacco displacement means extending cooperatingly with respect to said tobacco article receiving end into said tubular holder, which displacement means has an effective length which is less than the length of the preformed tobacco article and an effective thickness which will provide a tobacco-free longitudinal space congruent with the central longitudinal axis of said preformed tobacco upon removal of said displacement means from the tobacco article; and at least one magazine, comprising a longitudinal chamber constructed in the side wall of said tubular holder, for receiving an insert adapted for incorporation into the tobacco-free space formed in the tobacco article.

* * * * *